US006093059A

United States Patent [19]

Bogese

[11] Patent Number: 6,093,059

[45] Date of Patent: Jul. 25, 2000

[54] CONTACT CONFIGURATION IN MODULAR JACK

[75] Inventor: Stephen B. Bogese, Salem, Va.

[73] Assignee: Thomas & Betts International, Inc., Sparks, Nev.

[21] Appl. No.: 09/236,921

[22] Filed: Jan. 25, 1999

[51] Int. Cl.[7] ..... H01R 24/00

[52] U.S. Cl. ..... 439/676; 439/344

[58] Field of Search ..... 439/676, 344

[56] References Cited

U.S. PATENT DOCUMENTS

| | | | |
|---|---|---|---|
| 3,369,214 | 2/1968 | Krumreich | 439/676 |
| 5,064,387 | 11/1991 | Lybrand | 439/676 |
| 5,145,398 | 9/1992 | Manabe | 439/676 |
| 5,249,987 | 10/1993 | Kristiansen | 439/676 |
| 5,542,853 | 8/1996 | Bouchan | 439/676 |
| 5,639,266 | 6/1997 | Patel | 439/676 |
| 5,702,271 | 12/1997 | Steinman | 439/676 |
| 5,704,802 | 1/1998 | Loudermilk | 439/676 |

*Primary Examiner*—Gary F. Paumen
*Assistant Examiner*—Tho D. Ta
*Attorney, Agent, or Firm*—Hoffmann & Baron, LLP

[57] ABSTRACT

An improved modular telephone-style jack featuring an improved contact configuration. The modular jack directly couples a modular male plug to a printed circuit board. The jack features a contact having a lower linear beam in combination with an glide dimple so that the contact can extend forwardly once its upward movement during mating with a modular plug is restrained. The lower linear beam is lifted during engagement and remains lifted while mated with a contact in a modular male plug. As a result of lifting, the free end of the contact also lifts in a typically unrestrained manner. However, the space above a mounted jack may be limited by multiple boards stacked in close proximity or the jack may be adjacent a mounting bracket located around the jack. If the space above the jack is limited, the contact will only be able to lift to a height less than its unrestrained lifted height. In one embodiment, the glide dimple is an arcuate shape whose open side faces downward so that its uppermost curved surface is tangent to the underside of the cover or upper wall of the modular jack. As the cover lifts in concert with the free end of the contact, when the cover hits a physical stop and thus is restrained from further lift, the glide dimple slides forward along the underside of the cover. The contact extends forward as the contact in the male plug lifts the lower linear beam further to a fully mated position so as to absorb the additional lift via extension in a direction generally parallel with the lower linear beam.

8 Claims, 4 Drawing Sheets

CONTACT CONFIGURATION IN MODULAR JACK

BACKGROUND OF THE INVENTION

1. Field Of The Invention

The present invention relates to electrical connectors and, more particularly, is directed toward an improved contact design to be used in modular telephone-style jacks so that during mating, the contact has a bi-directional means of transferring vertical lift by a modular plug into both vertical and horizontal direction.

2. Description Of Related Art

Telephone-style modular jacks are widely used in the computer networking and communications industries for interconnection of computers, modems, printers, and similar electronic equipment.

As utilized herein, the terms "modular jack" and "modular plug" connote the miniature, interchangeable, quick-connect-and-disconnect jacks and plugs developed originally by Western Electric Company and Bell Telephone Laboratories. Examples of modular jacks and modular plugs may be seen as described in U.S. Pat. Nos. 3,699,498: 3,850,497; and 3,860,316.

Various modular jacks have been proposed for directly coupling a modular plug to a printed circuit board. Several designs of modular jacks for this application as described in U.S. Pat. Nos. 4,457,570 and 5,478,261 as well as several of my prior U.S. patents. In U.S. Pat. No. 4,457,570, there is described an improved modular jack that incorporates differential spacing. The principal feature of this improved modular jack is the provision of electrical conductors which enter the plug receiving opening of the jack from the rear of the jack. This provides for a shorter contact length than prior art jacks, resulting in substantial economies from using a reduced amount of costly spring material to make each contact, and reductions in the surface area that must be gold-plated in order to produce a reliable electrical connection between the contact of the jack and the contact in the male plug. While this design is an improvement of prior art designs, it suffers from several deficiencies. This particular design is subject to overstress of one or more contacts when mating with certain types of modular plugs.

The problem of overstress of one or more contacts is inherent in all prior art modular jacks. For example, there are four basic types of modular plugs. They are the four position, six position, eight position, and the ten position. Modular plugs were designed by Bell Telephone Laboratories to have virtually identical physical heights, and to place the releasable latching arm in the center of each plug with the same relative setback dimensions from the nose at the front of the plug, as may be seen in Federal Communications Commission Part 68, National Standards for Telephone Plugs and Jacks. The four types of plugs are essentially identical in their dimensions in the critical inter-mating front portion except that the width of the six position plug is 0.080 inches wider than the four position plug, and the width of the eight and ten position plugs are 0.080 inches wider than the six position plug. This design arrangement permits any plug to be mateably inserted into any jack of the same number position or any jack of a greater number position. For example, this means that a four position plug can be inserted into a four position jack, or a six position jack, or an eight position jack, or a ten position jack. Another example would be that a six position plug could be inserted into a six position jack, or an eight position jack. The consequence of inserting a six position plug is that the six contacts and their respective slots for receiving the corresponding female spring contacts operate exactly as a normal mated connection; however, for the outermost spring contacts, one of either side of the center spring contacts, there is no corresponding contact or receiving slot in the six position plug. When the plug is fully inserted, the outermost spring contacts are lifted to a height approximately 0.023 inches higher than the maximum normal height during mating. Severe stress is exerted against the outermost spring contacts under this mated condition, and the longer the duration of time that the smaller plug remains mated further induces time weighted stress on these outermost contacts. All prior art modular jacks, when subject to mating an eight position jack with a six position modular plug, have at least one outermost spring contact that becomes intermittent after typically only three insertions and remaining in a mated condition for only sixty seconds for each insertion.

U.S. Pat. No. 5,478,261 is designed to address this very serious potential type of field induced failure of a modular jack. An intermediate, transition portion of the contact joins the contact mating portion and joins the solder post portion of the spring contact. The contact mating portion is comprised of several sections: the lower linear beam, the lead-in, the forward tip, and the back angle section. The transition portion of the contact extends typically in a vertical fashion from the solder posts up to a radius directional changer, from which the transition portion typically extends horizontally forwardly toward the front face of the jack. The back angle-up connects to the transition portion and extends downwardly from the transition portion to connect to the lower linear beam. The back angle section enables the lower linear beam to be positioned within the jack so that its beam surface is lower than the horizontal part of the transition portion. The lead-in angles upward from the lower linear beam to the forward tip. The combination of lead-in section with the back angle section makes it possible to locate the mating beam surface relatively far away from the points of flexure for the contact, reducing the effects of the contact being lifted to a high lifted position, the source of excessive stress on the contacts of a modular jack. In addition, the beam surface, when lifted to normal lift height while mated, becomes parallel to the upper surface of the male contact in the plug. This dramatically improves the electrical properties of the connector as will be described hereinafter.

The demand for ever increasing electrical performance for the frequencies that a modular jack can effectively transmit is and continues to drive the need for constant improvement of modular jacks. All prior all jacks fail to deliver most of the signal when delivered at high frequencies such as 100 megabits per second (Mbps). Prior art jacks to my U.S. Pat. No. 5,478,261 mate with the male contact of the plug in an angular orientation of the spring contact of the jack. This results in a poor impedance match between the male contact of the plug and the spring contact of the female because the contacts are not substantially co-aligned with each other. The result of this poor impedance match is an unacceptable reflection of part of the original signal, thus delivering a much weaker signal to the destination. For example, prior art jacks typically have a VSWR of greater than 2.0 with signals transmitted at a frequency of 100 Mbps, while my '5,478,261 jack provides a VSWR of 1.1 at a frequency of 100 Mbps. This means that prior art jacks reflect away more than 33% of the transmitted signal, leaving less than ⅔ of the original signal to continue on to its destination. My '5,478,261 jack reflects away less than 5% of the transmitted signal, providing for more than 95% of the original signal to continue on.

U.S. Pat. No. 5,249,987 illustrates a further improvement to the design of U.S. Pat. No. 5,478,261 by providing a flexible cover located within the upper wall of the jack. This cover is designed to provide a dielectric barrier between the spring contacts and any external electrically charged surface or electrically conductive surface. The cover is made of polymers that have some flexibility in thin sections, thereby providing support for spring contacts which are lifted to a high lift position, and additionally providing for continuing dielectric isolation for the now lifted contacts. The cover will lift in concert with the spring contacts that are lifted such that it lifts equally to those spring contacts which experience the highest lift.

This improved jack still has a disadvantage in that in space limited computers, network boxes, and the like, there is not sufficient headroom above the upper wall of the jack for the spring contacts and the cover to flex to their fully unrestrained position when a smaller position plug is mated and specific contacts are lifted to a high lift position.

While the recent prior art has made significant improvements toward addressing the problem of providing stress resistance of the spring contacts within a modular jack, when those spring contacts are subject to high lift situations as a result of a smaller male plug being mated to a jack, it is towards enhancing the stress resistance of the prior art connectors that the present invention is advanced.

OBJECTS AND SUMMARY OF THE PRESENT INVENTION

A primary object of the present invention is to provide a modular female jack with an enhanced contact shape and design that utilizes a highly stress resistant contact design and a glide dimple to further improve stress resistance to overcome the deficiencies of the prior art.

Another object of the present invention is to provide a means for the spring contact of the jack to move in both a vertical direction and in a horizontal direction.

A further object of the present invention is to provide a spring contact having a dimple that can move with relative ease across a surface of a jack or a cover for the jack.

Yet another object of the present invention is to provide a means for the spring contact to primarily lift in a vertical fashion prior to extending itself in a horizontal fashion The foregoing and other objects and features are achieved in accordance with one aspect of the present invention by means of a spring contact consisting of a contact mating portion, a transfer portion, a solder tail portion, and a transition portion.

In accordance with another a spec t of the present invention, the transfer portion is located forwardly of the contact mating portion so that it can serve as a point of leverage for the spring contact.

In accordance with yet another aspect of the present invention, the contact mating portion is comprised of a lower linear beam, a back-angle section, a lead-in section in which the lower linear beam occupies a lower relative position within the jack than the horizontal part of the transition portion.

In accordance with a further aspect of the present invention, the transfer portion is forward of the lead-in section and has the shape of an arc whose open side faces the bottom of the jack.

DETAILED DESCRIPTION OF THE PREFERRED EMBODIMENTS

Figure 1:
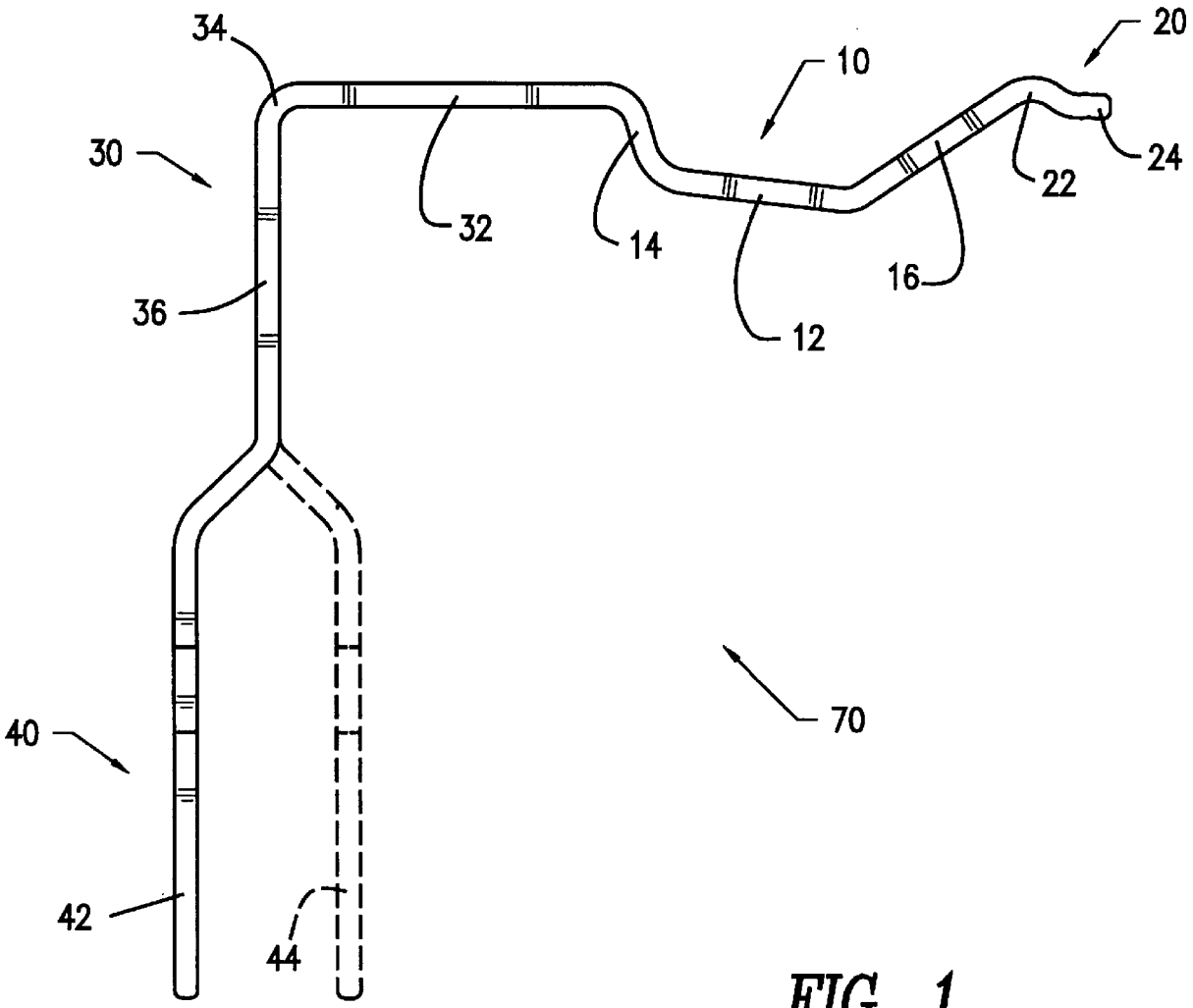
FIG. 1 is a side view of a spring contact having a lower linear beam featuring one type of a contact mating shape and designed for use in a modular female jack

Referring now to the drawings, wherein like reference numerals indicate identical or corresponding parts throughout the several views; more particularly, in FIG. 1, a preferred embodiment of the present invention is indicated generally by reference numeral 70.

The female spring contact 70 is comprised of four portions, each integrally joined with at least one other portion so that taken together, they define a unique contact design and shape. The transfer portion 20 consists of two sections, the tip 24, and the transfer dimple 22. Contact mating portion 10 consists of three sections, the lower linear or recessed beam 12, the back-angle 14, and the lead-in 16. Transition portion consists of a substantially horizontal section 32, a radius directional changer 34, and a substantially vertical section 36. Solder tail portion consists of a spreader section and solder post 42 or 44. Tip 24 is designed to hold the contact mating portion in a stable, controlled position relative to jack housing 80 (FIG. 3) by providing a surface that rests on the upper surface of an internal ledge (not shown) adjacent the front wall 84 of housing 80. The internal ledge is located below the top edges of separator(s) 54 and within the housing 80 just behind the top edge of front wall 84. Immediately adjacent tip 24 is guide dimple 22, having an arcuate shape disposed such that the open side of the arc faces away from the upper surface of connector 80. This provides a curved, smooth, burr free surface designed to move across the underside 64 of cover 60. The uppermost point of glide dimple 22 makes tangential contact with underside 64, resulting in a relatively low resistance by the cover 60 to move of glide dimple 22 across the surface of underside 64. Contact mating portion 10 is comprised of lead-in 16, which has an angular orientation relative to the front wall 84 of housing 80. This angular orientation allows the lead-in to engage the leading radius of a contact blade within a male plug so that the contact blade can gradually lift the contact mating portion as the contact blade of a plug moves in a direction toward the rear of the jack. This lifting action urges the lower linear beam 12 to lift so as to easily move onto the upper surface of a contact blade, resulting in a mated pair between the beam 12 and the upper surface of a contact blade. The back-angle 14 joins the lower linear beam to the transition portion 30, and more particularly, to the horizontal section 32 of the transition portion 30. This provides for the transition portion to act in unison with the contact mating portion, thereby providing a substantial length for distributing the stress that occurs as the result of lifting the contact mating portion during engagement with the contact blade of a plug. Transition portion consists of horizontal section 32, which provides a long span from the back-angle section and the radius directional changer 34. Radius directional changer joins to vertical section 36 through a curved shape. This combination absorbs stress delivered to the long span horizontal section 32, which takes on a slight bow shape under contact lift, while part of the lift stress travels through curved shape of radius changer 34, and then into the vertical section 36. The effect of this absorption of stress is to simulate the behavior of a much longer horizontal span, increasing the stress limit that the contact can handle so that the contact is not stress damaged by higher lifts. Solder tail portion 40 has solder post(s) 42, 44 which are designed to be inserted into plated thru holes in the printed circuit board.

Figure 2:
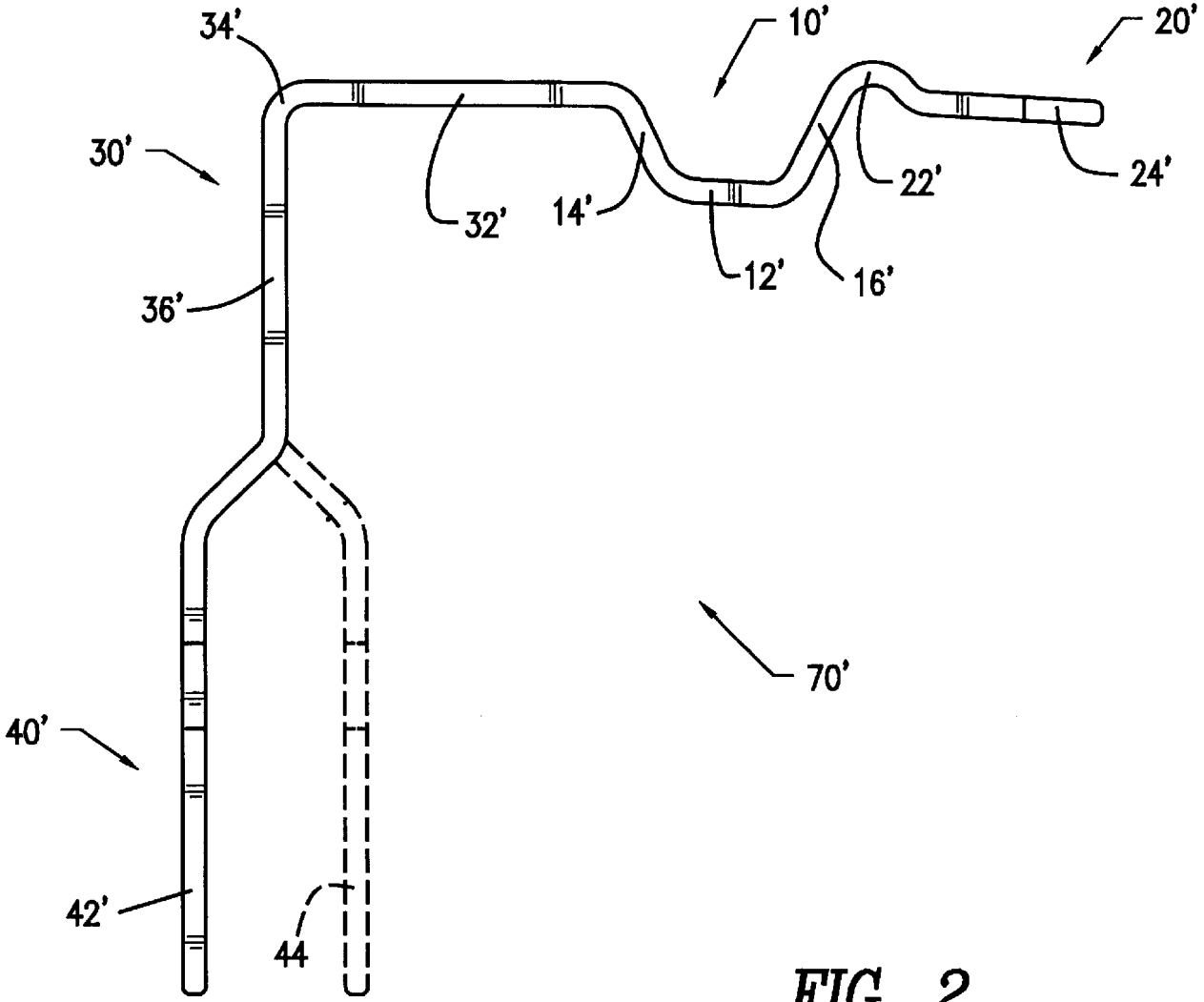
FIG. 2 is a side view of a spring contact having a lower linear beam featuring an alternate type of a contact mating shape and designed for use in a modular female jack

An alternate embodiment of spring contact 70' is shown in FIG. 2, in which contact mating portion 10' and transfer portion 20' correspond respectively to contact mating portion 10 and transfer portion 20 of FIG. 1. It may be seen that lower linear beam 12' of FIG. 2 is shorter in length than lower linear beam 12 of FIG. 1, that lead-in 16' of FIG. 2 has a greater angularity than lead-in 16 of FIG. 1, that glide dimple 22' of FIG. 2 has a larger arc than glide dimple 22 of FIG. 1, and that tip 24' of FIG. 2 is longer than tip 24 of FIG. 1. These differences are the result of alternate spring contact 70' of FIG. 2 having different functionality than spring contact 70 of FIG. 1. In European countries, there is a safety hazard requirement for connectors to reduce the likelihood of accidental contact with sources of electrical power. Under typical conditions, the voltage between two adjacent spring contacts will be 45 VDC. However, in response to an incoming call generating a ring indication, the voltage between the same two adjacent springs contacts could reach 120 VDC. Although this voltage generally is not hazardous to adults in good health, it could harm elderly persons, or persons with a medical condition. As a result, spring contact 70' has a shortened lower linear beam 12' and a more angular lead-in 16' so that the internally exposed contact mating portion 10' is recessed farther from the front wall 84 of jack 80. This substantially reduces the likelihood of accidental contact with voltages on spring contacts 10' in jack 80. This is a highly desirable feature with a clear safety benefit to consumer users of modular jacks or equipment containing modular jacks.

Figure 3:
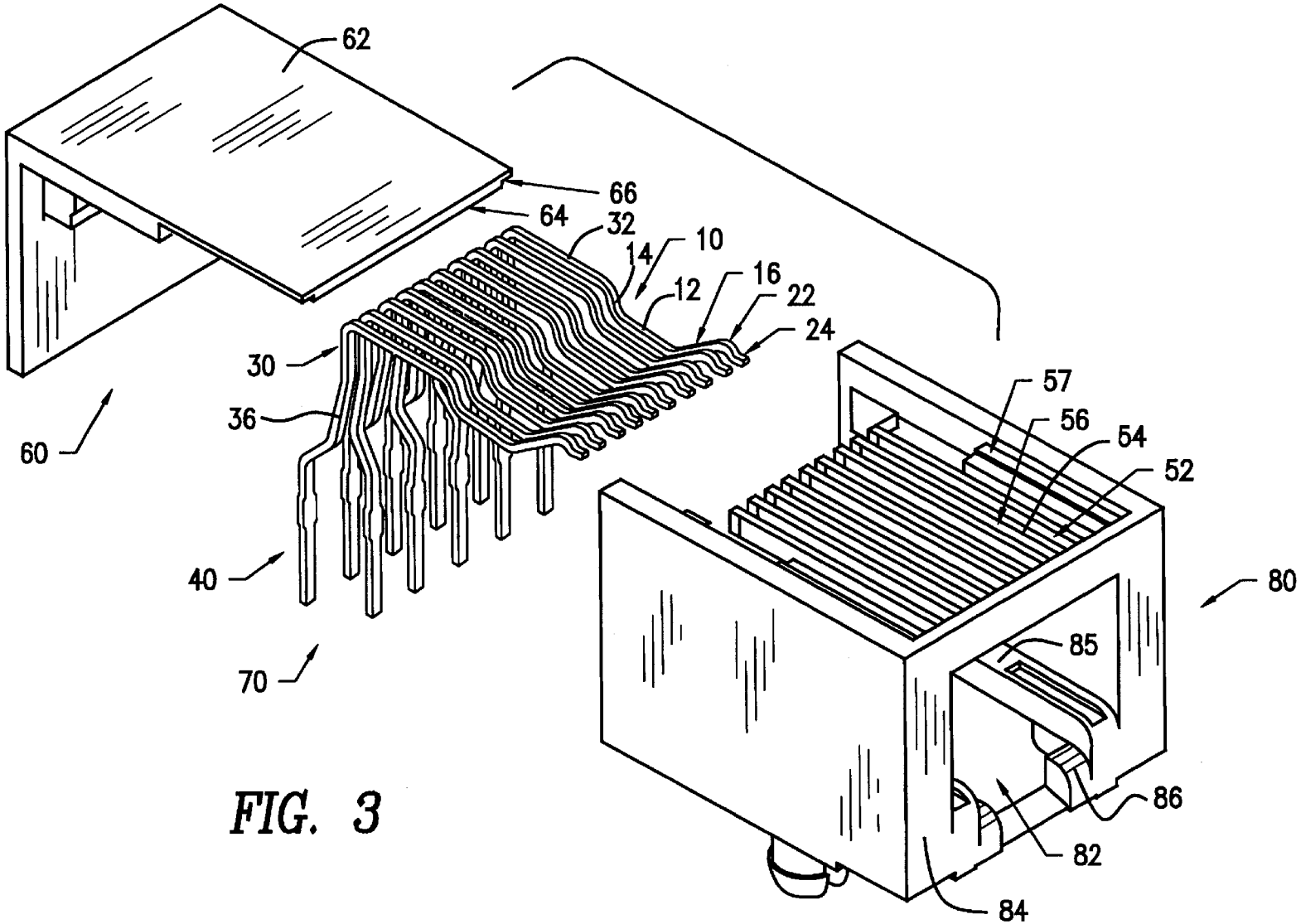
FIG. 3 is a perspective exploded view of a modular female jack illustrating the jack housing, one embodiment of the spring contacts, and the separable cover

Referring now to FIG. 3, the three primary components that make up a modular jack are shown in an exploded view. The separable cover 60, is interlocked into the housing 80 after the spring contacts 70 have been loaded into housing 80. Front wall 84 contains an opening 82, which is of a shape and size to accept a modular male plug into the opening 82. Adjacent front face 84 are two catches 86, located at the entrance of opening 82. These catches 86 are designed to capture two corresponding projections on the latching arm of a modular male plug. Surfaces 85 provide a guide and support surface for a modular male plug to ride on as the male plug is inserted into opening 82 until the male plug latching arm projections snap into engagement behind catches 86. Open channels 52 and 56 are of a width and length to accept one spring contact in each channel 52, 56 such that the width of channel 52 and channel 56 are wider than the width of spring contact 70 for contact sections 32, 14, 12, 16, 22, and 24. This provides the means for each spring contact 70 to freely move within its corresponding contact channel. As a result, spring contact 70 can follow the movement of a plug as it is inserted into opening 82 as well as after a male plug is fully seated within opening 82. Cover support ledge 57 is located along the upper surface of connector 80, and extends from front wall 84 rearwardly, having a length approximately one-half of the front to rear depth of connector 80. Support ledge 57 provides a physical stop and resting surface for a recessed channel 66 on the underside of separable cover 60. The result of support ledge 57 is that it maintains accurate positioning of front overhang 62 of cover 60, so that cover 60 does not change the force applied by spring contact(s) 70 until spring contacts have been lifted high enough such that transfer dimple 22 engages underside 64 of cover 60. Support ledge 57, with the overlap of recessed channel 66 of cover 60, and the side surface alignment between upper edge(s) 58 and outer edges of overhang 62, provides a greater dielectric barrier to voltages arcing from spring contact(s) 70 to an external bracket or frame. Glide dimple 22, as mating contact portion 10 is lifted when a male plug is inserted into opening 82, lifts correspondingly so as to engage underside 64 of cover 60. As overhang 62 lifts from the engagement of lifting glide dimple 22, overhang 62 continues to lift unrestrained unless it encounters a fixed object or surface. Any such fixed object or surface will prevent further lifting of overhand 62, and correspondingly prevent any further lifting of glide dimple 22, thereby stopping further vertical movement of contact mating portion 10. This causes glide dimple 22 to begin to slide along underside 64 of overhand 62 in a direction toward front wall 84 of housing 80. This results in the shape of contact mating portion 10 being compressed, causing tip 24 and glide dimple 22 to move and extend toward front wall 84, thereby absorbing the additional stress induced by high lifting of contact mating portion 10 and preventing permanent deformation of the contact mating portion 10. In addition, this permits the use of more rigid materials for the separable cover 60 so that cover 60 itself limits the amount of lift of spring contacts 70.

Figure 4:
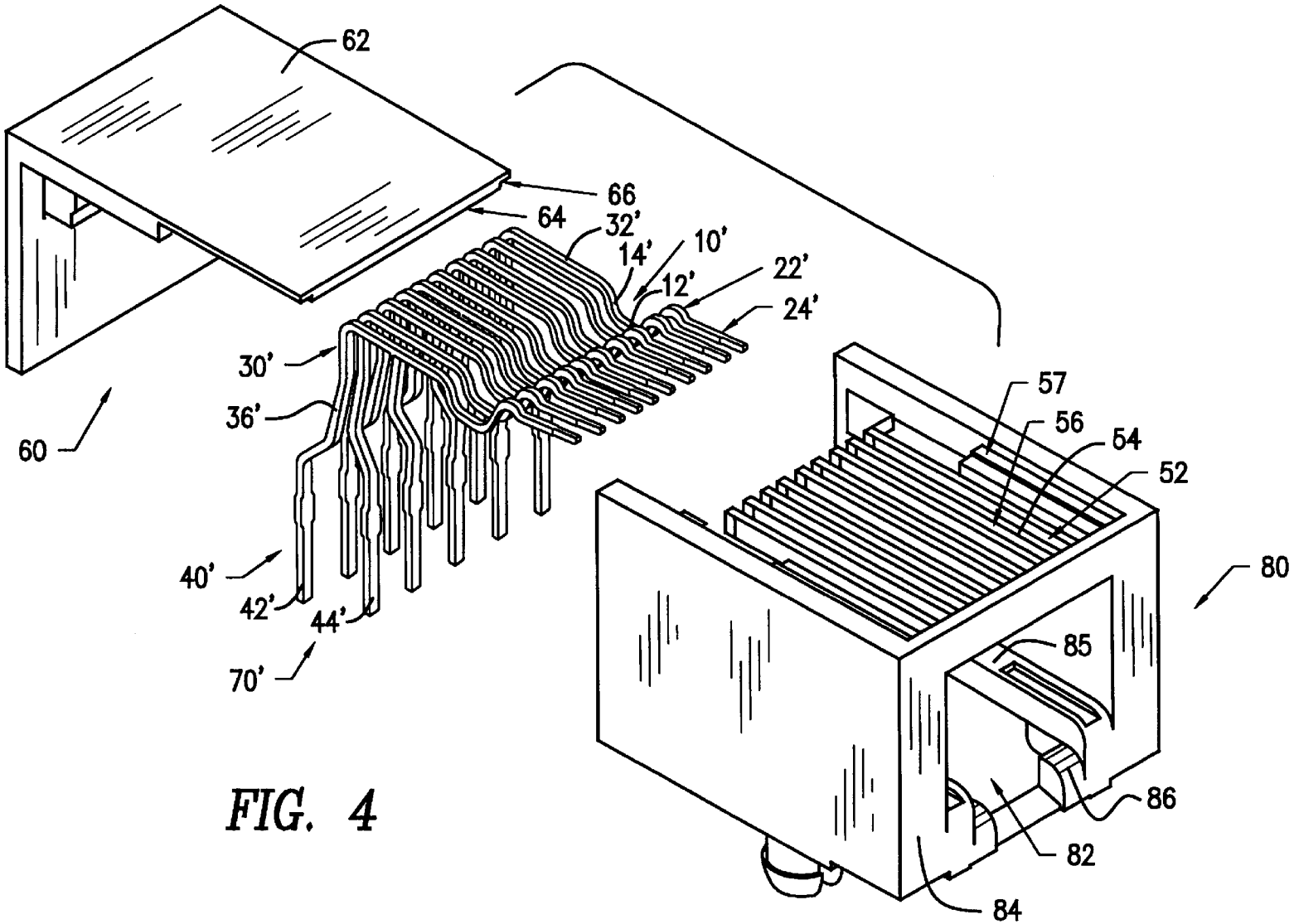
FIG. 4 is a perspective exploded view of a modular female jack illustrating the jack housing, an alternate embodiment of the spring contacts, and the separable cover

Referring now to FIG. 4, which illustrates an alternate embodiment of the present invention shown in perspective, exploded view. The connector housing 80, cover 60, and spring contact(s) 70' are assembled in a comparable process to that described for FIG. 3, in which analogous prime numbers functionally correspond to similar number's functions as described in FIG. 3.

It may be appreciated by virtue of the foregoing that I have developed a new and improved modular jack having a stress-resistant contact able to move in both horizontal and vertical directions to absorb stress created by high contact lift conditions from a male plug.

Obviously, numerous modifications and variations of the present invention are possible in light of the above teachings. It is therefore to be understood that within the scope of the appended claims, the invention may be practiced otherwise than as specifically described herein.

I claim as my invention:

1. A modular telephone-style jack for electrical connection with a mating telephone-style plug comprising:

a jack housing having an upper surface and a front wall having a plug receiving opening therein for accommodating said plug, said jack housing defining plural contact receiving slots;

a plurality of elongated electrical spring contacts positioned in respective slots of said housing, each said contact including a plug mating portion and a tail portion extending from said housing, said plug mating portion including a distal tip, a raised glide dimple proximal of said tip and a recessed contact beam proximal of said glide dimple, said plug mating portion being resiliently deformable upon said mating connection of said plug to deflect said recessed contact beam towards said upper surface and to urge said raised glide dimple against said upper surface wherein said raised glide dimple is more easily slidable along said upper surface in a direction towards said front wall.

2. A jack claim 1 wherein said plug mating portion of said contact includes:

a horizontal section forming a transition with said contact tail;

a back-angle section between said horizontal section and said recessed contact beam; and an angled lead-in between in said recessed contact beam and said glide dimple;

said plug mating portion of said contact having a tendency to flatten upon mating connection of said plug.

3. A jack of claim 1 wherein said housing includes a removable housing cover forming said housing upper surface.

4. A jack of claim 3 wherein said glide dimple is engageable with and movable along an undersurface of said housing cover.

5. A jack of claim 4 wherein said contact is deformable upon said mating plug connection to urge said glide dimple from a position in non-engagement with said cover undersurface to a position in engagement with said cover undersurface.

6. A jack of claim 5 wherein said housing includes a stop surface for supporting said cover and maintaining said undersurface of said cover in non-engagement with said glide dimple prior to said mating plug connection.

7. A jack of claim 6 wherein said cover includes a recessed channel adjacent said undersurface and said housing includes a support ledge forming said stop surface and accommodating said recessed channel of said cover.

8. A jack of claim 7 wherein said cover is liftable from said housing upon engagement of said glide dimple with said undersurface.

* * * * *